US006288139B1

(12) United States Patent
Skoglund

(10) Patent No.: US 6,288,139 B1
(45) Date of Patent: Sep. 11, 2001

(54) FOUNDRY BINDER SYSTEM CONTAINING AN ORTHO ESTER AND THEIR USE

(75) Inventor: Michael J. Skoglund, Dublin, OH (US)

(73) Assignee: Ashland Inc., Dublin, OH (US)

( * ) Notice: Subject to any disclaimer, the term of this patent is extended or adjusted under 35 U.S.C. 154(b) by 0 days.

(21) Appl. No.: 09/401,235

(22) Filed: Sep. 23, 1999

Related U.S. Application Data

(60) Provisional application No. 60/101,620, filed on Sep. 24, 1998.

(51) Int. Cl.[7] ..... B22C 1/22
(52) U.S. Cl. ..... 523/143; 523/142; 523/139
(58) Field of Search ..... 523/139, 142, 523/143, 144, 145, 146, 147

(56) References Cited

U.S. PATENT DOCUMENTS 3,354,100 * 11/1967 Kuryla ..... 260/2.5
3,409,579 * 11/1968 Robins ..... 260/30.4
3,485,797 * 12/1969 Robins ..... 260/57
3,535,359 10/1970 Chadwick et al. ..... 260/453
3,905,934 * 9/1975 Gardlikes ..... 260/31.8
4,028,343 6/1977 Amort et al. ..... 260/59
4,265,425 * 5/1981 Gardlikes ..... 260/19
4,338,240 * 7/1982 Mizutani et al. ..... 524/284
4,880,845 * 11/1989 Moss et al. ..... 521/114
5,902,840 * 5/1999 Singh et al. ..... 523/142
5,908,914 * 6/1999 Dando et al. ..... 528/129
6,017,978 * 1/2000 Chen et al. ..... 523/143

* cited by examiner

*Primary Examiner*—Edward J. Cain
*Assistant Examiner*—Katarzyna Wyrozebski-Lee
(74) *Attorney, Agent, or Firm*—David L. Hedden

(57) ABSTRACT

This invention relates to polyurethane-forming foundry binder systems comprising a phenolic resin component and a polyisocyanate component, where the polyisocyanate component contains an ortho ester. The invention also relates to foundry mixes prepared from the binder and an aggregate, as well as foundry shapes prepared by the no-bake and cold-box processes. The foundry shapes are used to make metal castings.

16 Claims, No Drawings

FOUNDRY BINDER SYSTEM CONTAINING AN ORTHO ESTER AND THEIR USE

The application claim benefit to provisional application No. 60/101,620 Sep. 24, 1998.

TECHNICAL FIELD

This invention relates to polyurethane-forming foundry binder systems comprising a phenolic resin component and a polyisocyanate component, where the polyisocyanate component contains an ortho ester. The invention also relates to foundry mixes prepared from the binder and an aggregate, as well as foundry shapes prepared by the no-bake and cold-box processes. The foundry shapes are used to make metal castings.

BACKGROUND OF THE INVENTION

One of the major processes used in the foundry industry for making metal parts is sand casting. In sand casting, disposable foundry shapes (usually characterized as molds and cores) are made by shaping and curing a foundry binder system that is a mixture of sand and an organic or inorganic binder. The binder is used to strengthen the molds and cores.

Two of the major processes used in sand casting for making molds and cores are the no-bake process and the cold-box process. In the no-bake process, a liquid curing agent is mixed with an aggregate and shaped to produce a cured mold and/or core. In the cold-box process, a gaseous curing agent is passed through a compacted shaped mix to produce a cured mold and/or core. Polyurethane-forming binders, cured with a gaseous tertiary amine catalyst, are often used in the cold-box process to hold shaped foundry aggregate together as a mold or core. See for example U.S. Pat. No. 3,409,579. The polyurethane-forming binder system usually consists of a phenolic resin component and polyisocyanate component which are mixed with sand prior to compacting and curing to form a foundry binder system.

Among other things, the binder must have a low viscosity, be gel-free, remain stable under use conditions, and cure efficiently. The foundry binder system made by mixing sand with the binder must have adequate benchlife or the mix will not shape and cure properly. The cores and molds made with the binders must have adequate tensile strengths under normal and humid conditions, and release effectively from the pattern. Binders which meet all of these requirements are not easy to develop.

Ortho esters are known in the prior art to stabilize organic isocyanates. U.S. Pat. No. 3,535,359 (Chadwick) discloses that certain ortho-esters are capable of stabilizing a polyisocyanate against several different kinds of degradation, for instance moisture, and viscosity increases, even when only small amounts of ortho esters are used. The stabilized isocyanates are useful in the preparation of polyurethane foam, nonporous plastics including polyurethane castings such as gear wheels and the like, and coating compositions. Chadwick does not disclose the use of such polyisocyanates in foundry binders, foundry mixes, or the preparation of foundry shapes and metal castings.

SUMMARY OF THE INVENTION

This present invention relates to a foundry binder system curable with a catalytically effective amount of an amine curing catalyst comprising:

A. a phenolic resin component; and

B. a polyisocyanate component comprising in admixture:

(1) an organic polyisocyanate;

(2) at least 5 weight percent of a non reactive organic solvent based upon the weight of (1); and (3) an effective amount of an ortho ester.

The foundry binder systems are preferably used to make molds and cores, preferably by the cold-box process which involves curing the molds and cores with a gaseous tertiary amine. The cured molds and cores are used to cast ferrous and non ferrous metal parts.

When added to a polyisocyanate component that contains a non reactive organic solvent, the ortho ester improves the tensile strength of foundry shapes, particularly in solvent systems that contain some moisture, and cases where the foundry shapes are coated with an aqueous coating. Improved tensile strengths are also observed for foundry shapes prepared with a foundry mixes that set unused for extended periods of time. Polyisocyanate components containing the ortho ester have lower turbidity, which indicates that it is more stable or homogeneous. As a result the polyisocyanate component will not be subjected to settling of particulate matter, and will be easier to pump.

BEST MODE AND OTHER MODES OF THE INVENTION INCLUDING

The phenolic resole resin is preferably prepared by reacting an excess of aldehyde with a phenol in the presence of either an alkaline catalyst or a metal catalyst. The phenolic resins are preferably substantially free of water and are organic solvent soluble. The preferred phenolic resins used in the subject binder compositions are well known in the art, and are specifically described in U.S. Pat. No. 3,485,797 which is hereby incorporated by reference. These resins, known as benzylic ether phenolic resole resins are the reaction products of an aldehyde with a phenol. They contain a preponderance of bridges joining the phenolic nuclei of the polymer which are ortho-ortho benzylic ether bridges. They are prepared by reacting an aldehyde and a phenol in a mole ratio of aldehyde to phenol of at least 1:1 in the presence of a metal ion catalyst, preferably a divalent metal ion such as zinc, lead, manganese, copper, tin, magnesium, cobalt, calcium, and barium.

The phenols use to prepare the phenolic resole resins include any one or more of the phenols which have heretofore been employed in the formation of phenolic resins and which are not substituted at either the two ortho-positions or at one ortho-position and the para-position. These unsubstituted positions are necessary for the polymerization reaction. Any of the remaining carbon atoms of the phenol ring can be substituted. The nature of the substituent can vary widely and it is only necessary that the substituent not interfere in the polymerization of the aldehyde with the phenol at the ortho-position and/or para-position. Substituted phenols employed in the formation of the phenolic resins include alkyl-substituted phenols, aryl-substituted phenols, cyclo-alkyl-substituted phenols, aryloxy-substituted phenols, and halogen-substituted phenols, the foregoing substituents containing from 1 to 26 carbon atoms and preferably from 1 to 12 carbon atoms.

Specific examples of suitable phenols include phenol, 2,6-xylenol, o-cresol, p-cresol, 3,5-xylenol, 3,4-xylenol, 2,3,4-trimethyl phenol, 3-ethyl phenol, 3,5-diethyl phenol, p-butyl phenol, 3,5-dibutyl phenol, p-amyl phenol, p-cyclohexyl phenol, p-octyl phenol, 3,5-dicyclohexyl phenol, p-phenyl phenol, p-crotyl phenol, 3,5-dimethoxy phenol, 3,4,5-trimethoxy phenol, p-ethoxy phenol, p-butoxy phenol, 3-methyl-4-methoxy phenol, and p-phenoxy phenol. multiple ring phenols such as bisphenol A are also suitable.

The aldehyde used to react with the phenol has the formula RCHO wherein R is a hydrogen or hydrocarbon radical of 1 to 8 carbon atoms. The aldehydes reacted with the phenol can include any of the aldehydes heretofore employed in the formation of phenolic resins such as formaldehyde, acetaldehyde, propionaldehyde, furfuraldehyde, and benzaldehyde. The most preferred aldehyde is formaldehyde.

The phenolic resin used must be liquid or organic solvent-soluble. The phenolic resin component of the binder composition is generally employed as a solution in an organic solvent. The amount of solvent used should be sufficient to result in a binder composition permitting uniform coating thereof on the aggregate and uniform reaction of the mixture. The specific solvent concentration for the phenolic resins will vary depending on the type of phenolic resins employed and its molecular weight. In general, the solvent concentration will be in the range of up to 80% by weight of the resin solution and preferably in the range of 20% to 80%.

The polyisocyanate component of the binder typically comprises a polyisocyanate and organic solvent. The polyisocyanate has a functionality of two or more, preferably 2 to 5. It may be aliphatic, cycloaliphatic, aromatic, or a hybrid polyisocyanate. Mixtures of such polyisocyanates may be used. Also, it is contemplated that capped polyisocyanates, prepolymers of polyisocyanates, and quasi prepolymers of polyisocyanates can be used. Optional ingredients such as release agents may also be used in the polyisocyanate hardener component.

Representative examples of polyisocyanates which can be used are aliphatic polyisocyanates such as hexamethylene diisocyanate, alicyclic polyisocyanates such as 4,4'-dicyclohexylmethane diisocyanate, and aromatic polyisocyanates such as 2,4' and 2,6-toluene diisocyanate, diphenylmethane diisocyanate, and dimethyl derivates thereof. Other examples of suitable polyisocyanates are 1,5-naphthalene diisocyanate, triphenylmethane triisocyanate, xylylene diisocyanate, and the methyl derivates thereof, polymethylenepolyphenyl isocyanates, chlorophenylene-2,4-diisocyanate, and the like.

The polyisocyanates are used in sufficient concentrations to cause the curing of the phenolic resin when gassed with the curing catalyst. In general the polyisocyanate ratio of the polyisocyanate to the hydroxyl of the phenolic resin is from 1.25:1 to 1:1.25, preferably about 1:1. Expressed as weight percent, the amount of polyisocyanate used is from 10 to 500 weight percent, preferably 20 to 300 weight percent, based on the weight of the phenolic resin.

The polyisocyanate is used in a liquid form. Solid or viscous polyisocyanate must be used in the form of organic solvent solutions. In general, the solvent concentration will be in the range of up to 80% by weight of the resin solution and preferably in the range of 20% to 80%.

Those skilled in the art will know how to select specific solvents for the phenolic resin component, and in particular the solvents required in the polyisocyanate component. It is known that the difference in the polarity between the polyisocyanate and the phenolic resins restricts the choice of solvents in which both components are compatible. Such compatibility is necessary to achieve complete reaction and curing of the binder compositions of the present invention. Polar solvents of either the protic or aprotic type are good solvents for the phenolic resin, but have limited compatibility with the polyisocyanate. Aromatic solvents, although compatible with the polyisocyanate, are less compatible with the phenolic results. It is, therefore, preferred to employ combinations of solvents and particularly combinations of aromatic and polar solvents.

Examples of aromatic solvents include xylene and ethylbenzene. The aromatic solvents are preferably a mixture of aromatic solvents that have a boiling point range of 125° C. to 250° C. The polar solvents should not be extremely polar such as to become incompatible with the aromatic solvent. Suitable polar solvents are generally those which have been classified in the art as coupling solvents and include furfural, furfuryl alcohol, Cellosolve acetate, butyl Cellosolve, butyl Carbitol, diacetone alcohol, and "Texanol".

As was mentioned previously, the polyisocyanate component contains an ortho esters. The ortho esters used have the formula $R'C(OR)_3$, where R' is hydrogen, alkyl, alkenyl, aryl, haloalkyl and R is alky or alkenyl of 1 to 18 carbon atoms, chloroethyl, or phenyl. The ortho esters are disclosed in U.S. Pat. No. 3,535,359 which is incorporated by reference into this specification. Preferably used are triethyl orthoformate, trimethyl orthoformate, and mixtures thereof. The amount of ortho ester used in the binder is from 0.1 to 5.0 weight percent based upon the weight of the binder, preferably from 0.1 to 1.5 weight percent, most preferably from 0.1 to 0.4 weight percent A useful optional component for the polyisocyanate component is a natural oil. The natural oil can be added to the phenolic resin component, isocyanate component, or both, preferably to the isocyanate component. Compatible natural oils are highly preferred. A natural oil is considered to be compatible with the organic isocyanate and/or phenolic resin if the mixture does not separate into two phases at room temperature, and preferably will not separate at temperatures between 30° C. to 0° C. Natural oils include unmodified natural oils as well as their various known modifications, e.g., the heat bodied air-blown, or oxygen-blown oils such as blown linseed oil and blown soybean oil. They are generally classified as esters of ethylenically unsaturated fatty acids. Preferably the viscosity of the natural oil is from A to J on the Gardner Holt viscosity index, more preferably from A to D, and most preferably A to B. Preferably the acid value of the natural oil is from about 0 to about 10, more preferably about 0 to about 4, and most preferably about 0 to about 2 as measured by the number of milligrams of potassium hydroxide needed to neutralize a 1 gram sample of the natural oil.

The natural oils are used in the phenolic resin component, isocyanate component, or both in an effective amount sufficient to improve the tensile strength of the foundry shapes made with the binders. This amount will generally range from about 1 percent by weight to about 15 percent by weight, most preferably about 2 percent to about 10 percent by weight, based upon the weight of the isocyanate component. Typically less amounts of natural oil are used in the phenolic resin component, generally from about 1 percent by weight to about 5 percent by weight, most preferably about 1 percent to about 3 percent by weight, based upon the weight of the phenolic resin component.

Representative examples of natural oils which are used in the isocyanate component are linseed oil including refined linseed oil, epoxidized linseed oil, alkali refined linseed oil, soybean oil, cottonseed oil, RBD Canola oil, refined sunflower oil, tung oil, and dehydrated castor oil. Preferably used as the natural oil are purer forms of natural oils which are treated to remove fatty acids and other impurities. These purer forms of natural oils typically consist of triglycerides and less than 1 weight percent of impurities such as fatty acids and other impurities. Specific examples of these purer natural oils are polymerized linseed oils (PLO) such as supreme linseed oil with an acid value of about 0.30 maximum and a viscosity of A and purified soybean oils such as refined soybean oil having an acid value of less than 0.1 and and viscosity of A to B. This is known to increase tensile strengths of foundry shapes.

In addition, the solvent component can include drying oils such as disclosed in U.S. Pat. No. 4,268,425. Such drying oils include glycerides of fatty acids which contain two or more double bonds. Also, esters of ethylenically unsaturated fatty acids such as tall oil esters of polyhydric alcohols or monohydric alcohols can be employed as the drying oil. In addition, the binder may include liquid dialkyl esters such as dialkyl phthalate of the type disclosed in U.S. Pat. No. 3,905,934 such as dimethyl glutarate, dimethyl succinate; and mixtures of such esters.

The binder may also contain a silane (typically added to the phenolic resin component) having the following general formula:

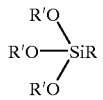

wherein R' is a hydrocarbon radical and preferably an alkyl radical of 1 to 6 carbon atoms and R is an alkyl radical, an alkoxy-substituted alkyl radical, or an alkyl-amine-10 substituted alkyl radical in which the alkyl groups have from 1 to 6 carbon atoms. The silane is preferably added to the phenolic resin component in amounts of 0.01 to 2 weight percent, preferably 0.1 to 0.5 weight percent based on the weight of the phenolic resin component.

When preparing an ordinary sand-type foundry shape, the aggregate employed has a particle size large enough to provide sufficient porosity in the foundry shape to permit escape of volatiles from the shape during the casting operation. The term "ordinary sand-type foundry shapes," as used herein, refers to foundry shapes which have sufficient porosity to permit escape of volatiles from it during the casting operation.

The preferred aggregate employed for ordinary foundry shapes is silica wherein at least about 70 weight percent and preferably at least about 85 weight percent of the sand is silica. Other suitable aggregate materials include zircon, olivine, aluminosilicate, sand, chromite sand, and the like. Although the aggregate employed is preferably dry, it can contain minor amounts of moisture.

In molding compositions, the aggregate constitutes the major constituent and the binder constitutes a relatively minor amount. In ordinary sand type foundry applications, the amount of binder is generally no greater than about 10% by weight and frequently within the range of about 0.5% to about 7% by weight based upon the weight of the aggregate. Most often, the binder content ranges from about 0.6% to about 5% by weight based upon the weight of the aggregate in ordinary sand-type foundry shapes.

The binder compositions are preferably made available as a two-package system with the phenolic resin component in one package and the polyisocyanate component in the other package. Usually, the phenolic resin component is first mixed with sand and then the polyisocyanate component is added. Methods of distributing the binder on the aggregate particles are well-known to those skilled in the art.

The foundry binder system is molded into the desired shape, such as a mold or core, and cured. Curing by the cold-box process is carried out by passing a volatile tertiary amine, preferably triethyl amine, through the shaped mix as described in U.S. Pat. No. 3,409,579. Curing by the no-bake process is takes place by mixing a liquid amine curing catalyst into the foundry binder system, shaping it, and allowing it to cure.

Useful liquid amines have a pKb value generally in the range of about 7 to about 11. Specific examples of such amines include 4-alkyl pyridines, isoquinoline, arylpyridines, 1-methylbenzimidazole, and 1,4-thiazine. Preferably used as the liquid tertiary amine catalyst is an aliphatic tertiary amine, particularly tris (3-dimethylamino) propylamine). In general, the concentration of the liquid amine catalyst will range from about 0.2 to about 5.0 percent by weight of the phenolic resin, preferably 1.0 percent by weight to 4.0 percent by weight, most preferably 2.0 percent by weight to 3.5 percent by weight based upon the weight of the polyether polyol.

The following abbreviations and components are used in the Examples:

Abbreviations

PPPI=polyphenylene polymethylene polyisocyanate having functionality of about 2 to 3.

ASA=aromatic solvent having a boiling point of 210°–290° C.

ASB=aromatic solvent having a boiling point of 150°–170° C.

ASC=aromatic solvent having a boiling point of 180°–210° C.

ESTA=ester solvent having a boiling point of 195°–225° C.

ESTB=ester solvent having a boiling point of about 360° C.

PLO=polymerized linseed oil.

TEOF=triethyl orthformate.

PR=a polybenzylic ether phenolic resin prepared with zinc acetate dihydrate as the catalyst and modified with the addition of 0.09 mole of methanol per mole of phenol prepared along the lines described in the examples of U.S. Pat. No. 3,485,797.

EXAMPLES

A Control Part II (A) was formulated and a corresponding formulation containing TEOF was formulated. The formulations are shown in the Table that follows:

TABLE I

| COMPONENT | A | WITH TEOF |
|---|---|---|
| PPPI | 80.0 | 80.0 |
| ASA | 10.0 | 9.5 |
| ASC | 5.0 | 5.0 |
| PLO | 5.0 | 5.0 |
| TEOF | 0.0 | 0.5 |

The transmission of various wavelengths (500 nm, 600 nm, and 700 nm) of light through the formulations was measured by with aVarian Cary E-1 UV-Visable Spectrophotometer using Hellma QS 1000 quartz cells initially, after 1 day, and after 2 days. The results are show in Tables II–IV below.

TABLE II

| % Transmittance (500 nm) | | | |
|---|---|---|---|
| | AGE OF FORMULATION (DAYS) | | |
| FORMULATION | 0 | 1 | 2 |
| A | 20.6 | 13.4 | 9.2 |
| WITH TEOF | 24.6 | 25.7 | 27.3 |

TABLE III

| % Transmittance (600 nm) | | | |
|---|---|---|---|
| | AGE OF FORMULATION (DAYS) | | |
| FORMULATION | 0 | 1 | 2 |
| A | 46.0 | 30.1 | 19.5 |
| WITH TEOF | 51.4 | 49.7 | 50.7 |

TABLE IV

| % Transmittance (700 nm) | | | |
|---|---|---|---|
| | AGE OF FORMULATION (DAYS) | | |
| FORMULATION | 0 | 1 | 2 |
| A | 59.1 | 40.3 | 26.1 |
| WITH TEOF | 66.8 | 62.2 | 61.0 |

The data in Tables II to IV indicate that the polyisocyanate component containing the reactive organic solvent and TEOF transmitted more light at the specified wavelengths. Thus the formulation with TEOF was less turbid, which indicates that it is more stable or homogeneous. As a result the polyisocyanate component will not be subjected to settling of particulate matter, and will be easier to pump.

Several test cores were prepared to illustrate the use of the invention. The phenolic resin component and polyisocyanate components used in the Examples are shown in Table V and VI which follow. Example A is a control and does not contain TEOF.

TABLE V

| PART I (PHENOLIC RESIN COMPONENT) | |
|---|---|
| Component | (pbw) |
| PR | 55.0 |
| ESTA | 14.0 |
| ASA | 14.0 |
| ESTB | 10.0 |
| ASB | 7.0 |

TABLE VI

| PART II (POLYISOCYANATE COMPONENT) | | | |
|---|---|---|---|
| | EXAMPLE | | |
| COMPONENT | A | 1 | 2 |
| PPPI | 69.3 | 69.3 | 69.3 |
| ASA | 10.09 | 10.02 | 9.96 |
| ASB | 10.09 | 10.02 | 9.96 |

TABLE VI-continued

| PART II (POLYISOCYANATE COMPONENT) | | | |
|---|---|---|---|
| | EXAMPLE | | |
| COMPONENT | A | 1 | 2 |
| ASC | 10.09 | 10.02 | 9.96 |
| TEOF | 0.00 | 0.20 | 0.40 |

One hundred parts of binder (Part I first and then Part II) were mixed with Wedron 540 sand such that the weight ratio of Part I to Part II was 55/45 and the binder level was 2.0 weight percent. The resulting foundry mix is forced into a dogbone-shaped corebox by blowing it into the corebox. The shaped mix in the corebox is then contacted with trethyl amine (TEA) at 20 psi for 1 second, followed by a 6 second nitrogen purge at 40 psi., thereby forming AFS tensile strength samples (dog bones) using the standard procedure.

The laboratory temperature was 24° C. and the relative humidity (RH) was 64%. The temperature of the constant temperature room (CT) was 25° C. and the relative humidity was 50%.

The tensile strengths of the test cores made according to the examples were measured on a Thwing Albert Intellect II instrument. Tensile strengths were measured on freshly mixed sand. In order to check the resistance of the test cores to degradation by humidity, the test cores were stored in a humidity chamber for 24 hours at a humidity of 90 percent relative humidity. The results are set forth in Table VII.

Measuring the tensile strength of the test core enables one to predict how the mixture of sand and polyurethane-forming binder will work in actual foundry operations. Lower tensile strengths for the test cores indicate that the phenolic resin and polyisocyanate reacted more extensively prior to curing and/or that the cores degraded due to humidity.

TABLE VII

| TENSILE STRENGTHS (PSI) OF TEST CORES PREPARED WITH AND WITHOUT TEOF | | |
|---|---|---|
| | ZERO BENCH TENSILE STRENGTHS (psi) | |
| Example | TEOF | 24hr @ 90% RH |
| A | 0.0 | 123 |
| 1 | 0.2 | 145 |
| 2 | 0.4 | 140 |

The data in Table VII indicate that the binders, with the TEOF at 0.2 (Example 1) and 0.4 (Example 2) weight percent in the polyisocyanate component, show improved tensiles strengths of cores after exposure to 90% relative humidity.

Similar tests were carried out with Manley IL5W Lake sand at a binder level of 1.5 weight percent. The formulation for the phenolic resin component is set forth in Table VIII. The formulation for the polyisocyanate component is set forth in Table IX.

TABLE VIII

| PART I (PHENOLIC RESIN COMPONENT) | |
|---|---|
| Component | (pbw) |
| PR | 50.0 |
| ESTA | 25.0 |
| ASA | 25.0 |

TABLE IX

| PART II (POLYISOCYANATE COMPONENT) | | | |
|---|---|---|---|
| | EXAMPLE | | |
| COMPONENT | A | 3 | 4 |
| PPPI | 52.0 | 52.0 | 52.0 |
| ASA | 20.0 | 20.0 | 20.0 |
| ASB | 28.0 | 27.8 | 27.5 |
| TEOF | 0.00 | 0.2 | 0.5 |

Tensile strengths for the test cores were measured, as described previously, on freshly mixed sand (zero bench time ) immediately (IMM), 1 hour, and 24 hours after curing. In order to check the resistance of the test cores to degradation by humidity, the test cores were also stored in a humidity chamber for 24 hours at a humidity of 90 percent relative humidity. Test cores were also coated with Ashland Chemical VELVAPLAST® CGW4, an aqueous graphite dispersion paste diluted to 36° Baume with water. The coated test cores were dried in a forced air oven for 15 minutes at 350° F. and tested cold, one hour after curing. The results are set forth in Table X.

TABLE X

| TENSILE STRENGTHS (PSI) OF TEST CORES MADE WITH WEDRON SAND PREPARED WITH AND WITHOUT TEOF | | | | | | |
|---|---|---|---|---|---|---|
| | ZERO BENCH TENSILE STRENGTHS (psi) | | | | | |
| Example | TEOF | IMM | 1 hr | 24 hr | 24 hr @ 90% RH | Corewash/ Cold |
| A | 0.0 | 46 | 62 | 79 | 53 | 70 |
| 3 | 0.2 | 59 | 95 | 104 | 73 | 83 |
| 4 | 0.5 | 48 | 71 | 89 | 52 | 81 |

The data in Table X indicate that the binders, containing TEOF at 0.2 (Example 3) and 0.5 (Example 4) weight percent in the polyisocyanate component (particularly at the 0.2 provided test cores with increased tensile strengths when compared to test the binder which did not contain TEOF. The addition of TEOF also improves the tensile strengths of cores having a corewash when the tensile strengths of the test cores are measured on cold test cores.

What is claimed is:

1. A foundry binder system comprising:

A. a phenolic resin component; and

B. a polyisocyanate component comprising:

(1) an organic polyisocyanate;

(2) at least 5 weight percent of a non reactive organic solvent based upon the weight of (1);

(3) from 0.1 weight percent to 5.0 weight percent of an ortho ester, where said weight percent is based upon the weight of the polyisocyanate component of the binder.

2. The foundry binder system claim 1 wherein the phenolic resin component comprises a (a) a polybenzylic ether phenolic resin prepared by reacting an aldehyde with a phenol such that the molar ratio of aldehyde to phenol is from 1.1:1 to 3:1 in the presence of a divalent metal catalyst, and (b) a solvent in which the resole resin is soluble.

3. The foundry binder system of claim 2 wherein the phenol is selected from the group consisting of phenol, o-cresol, p-cresol, and mixtures thereof.

4. The foundry binder system of claim 3 wherein the aldehyde is formaldehyde.

5. The foundry binder system of claim 4 wherein the NCO content of the polyisocyanate component is from 12% to 33%.

6. The foundry binder system of claim 5 where the ortho ester is selected from the group consisting of triethyl orthoformate, trimethyl orthoformate, and mixtures thereof, such that the amount of ortho ester is from 0.1 weight percent to 1.5 weight percent based upon the weight of the polyisocyanate component of the binder.

7. The foundry binder system of claim 6 wherein the ratio of hydroxyl groups of the polybenzylic ether phenolic resin to the polyisocyanate groups of the polyisocyanate hardener is from 0.80:1.2 to 1.2:0.80.

8. The foundry binder system of claim 7 wherein the divalent metal catalyst used to prepare the phenolic resin is zinc.

9. The foundry binder system of claim 8 that also contains a natural oil.

10. The foundry binder system of claim 9 wherein the natural oil is polymerized linseed oil.

11. A foundry mix comprising:

A. a major amount of an aggregate; and

B. an effective bonding amount of the binder system of claims 1, 2, 3, 4, 5, 6, 7, 8, 9, or 10.

12. A process for preparing a foundry shape which comprises:

(a) forming a foundry mix as set forth in claim 11;

(b) forming a foundry shape by introducing the foundry mix obtained from step (a) into a pattern;

(c) contacting the shaped foundry binder system with a tertiary amine catalyst; and (d) removing the foundry shape of step (c) from the pattern.

13. The process of claim 12 wherein the tertiary amine catalyst is a gaseous tertiary amine catalyst.

14. The process of claim 12 wherein the amount of said binder composition is about 0.6 percent to about 5.0 percent based upon the weight of the aggregate.

15. The process of claim 12 wherein the tertiary amine catalyst is a liquid tertiary amine catalyst.

16. The process of casting a metal which comprises:

(a) preparing a foundry shape in accordance with claim 12;

(b) pouring said metal while in the liquid state into and a round said shape;

(c) allowing said metal to cool and solidify; and (d) then separating the molded article.

* * * * *